US005921707A

United States Patent [19]

Owen

[11] Patent Number: 5,921,707

[45] Date of Patent: Jul. 13, 1999

[54] METHOD OF FILLING AN EXCAVATED OPENING

[75] Inventor: Raymond Caulton Owen, Morpeth, United Kingdom

[73] Assignee: BG plc, United Kingdom

[21] Appl. No.: 08/981,214

[22] PCT Filed: Jun. 21, 1996

[86] PCT No.: PCT/GB96/01503

§ 371 Date: Mar. 6, 1998

§ 102(e) Date: Mar. 6, 1998

[87] PCT Pub. No.: WO97/01002

PCT Pub. Date: Jan. 9, 1997

[30] Foreign Application Priority Data

Jun. 21, 1995 [GB] United Kingdom ..... 9512608

[51] Int. Cl.[6] ..... E01C 21/00; F16L 1/028

[52] U.S. Cl. ..... 404/75; 404/76; 404/82; 405/154; 405/179

[58] Field of Search ..... 404/75, 76, 82; 405/154, 179, 263, 264, 266, 267

[56] References Cited

U.S. PATENT DOCUMENTS 4,329,083 5/1982 Parkinson ..... 405/154
4,557,626 12/1985 McKay et al. .
4,815,891 3/1989 O'Connor .
4,946,307 8/1990 Jakob .
5,026,206 6/1991 O'Connor .

FOREIGN PATENT DOCUMENTS 386516 1/1933 United Kingdom .

*Primary Examiner*—James A. Lisehora
*Attorney, Agent, or Firm*—Larson & Taylor

[57] ABSTRACT

An excavated opening (10) through a pavement (12) of a highway and through the underlying base material (14) to expose a gas main (16) is filled by (i) mixing on site cement, foaming agent and water to produce a fluid grout (26), (ii) mixing the grout with loose excavated spoil (22) in the opening, (iii) agitating the mixture using a hand-held poker vibrator (30), (iv) and repeating this procedure until the level (40) is reached. The level (40) corresponds to the underside of a protective layer (50) which is subsequently applied. The majority of the excavated loose spoil from the opening is reused.

8 Claims, 2 Drawing Sheets

10
12
14
16
18
20
22
26
28
29
32

METHOD OF FILLING AN EXCAVATED OPENING

The invention relates to filling of excavated openings through the surfaces of highways, including carriageways and footways, and through the underlying base material thereof.

The surface might include, for example, bituminous material, concrete or modular paving, such as flagstones, block paving or stone setts.

Such openings are typically required where a buried service such as a gas pipe, water main, sewer or electric cable, which is buried beneath the highway, has to be exposed by excavation for the purposes of repair, for example.

A method for filling such an opening has been proposed in U.S. Pat. No. 5,026,206 (Patrick L O'Connor). In that specification it is proposed to transfer a quantity of broken pavement and underlying base material from an opening, mix it with water and a binder material to form a fluid, unshrinkable, settable filler mixture and apply the filler mixture to the opening. Apparatus is proposed in that specification for carrying out the method, such apparatus comprising means for transferring broken pavement and underlying base material from an opening; hopper means mounted on a vehicle for storing the removed materials, mixing means including a mixing chamber for mixing the removed material with water and a binder material to form the filler mixture; and means disposed in communication with the mixing chamber for applying the filler mixture to the opening.

The object of the present invention is to provide a method of filling by which the filler mixture is mixed in the opening.

According to the invention, a method of filling of an excavated opening through the surface of a highway and through the underlying base material comprises (i) placing loose excavated spoil from the excavated opening or from some other similar excavated opening (separated from excavated oversize bituminous bound or rigid pavement material) and grout in the opening and adding spoil progressively until the spoil appears at the surface of the grout;

(ii) agitating the mixture of grout and spoil in the opening using mechanical equipment until the grout penetrates the voids in the spoil;

(iii) adding further spoil;

(iv) agitating the mixture until further agitation proves difficult; and (v) repeating steps (i) to (iv) until the surface of the mixture in the opening reaches a level which corresponds or approximately corresponds to the underside of the surfacing layer of the highway.

Preferably, at each level of the opening, spoil is used which is equivalent to the existing layers in the walls of the opening.

It is also preferable that the excavated spoil is produced by excavating the opening which is to be filled.

Preferably, the majority of the excavated spoil is reused.

One embodiment of the method according to the invention will now be described by way of example with reference to the accompanying drawings in which.

Figures 1, 2, 3, 4:
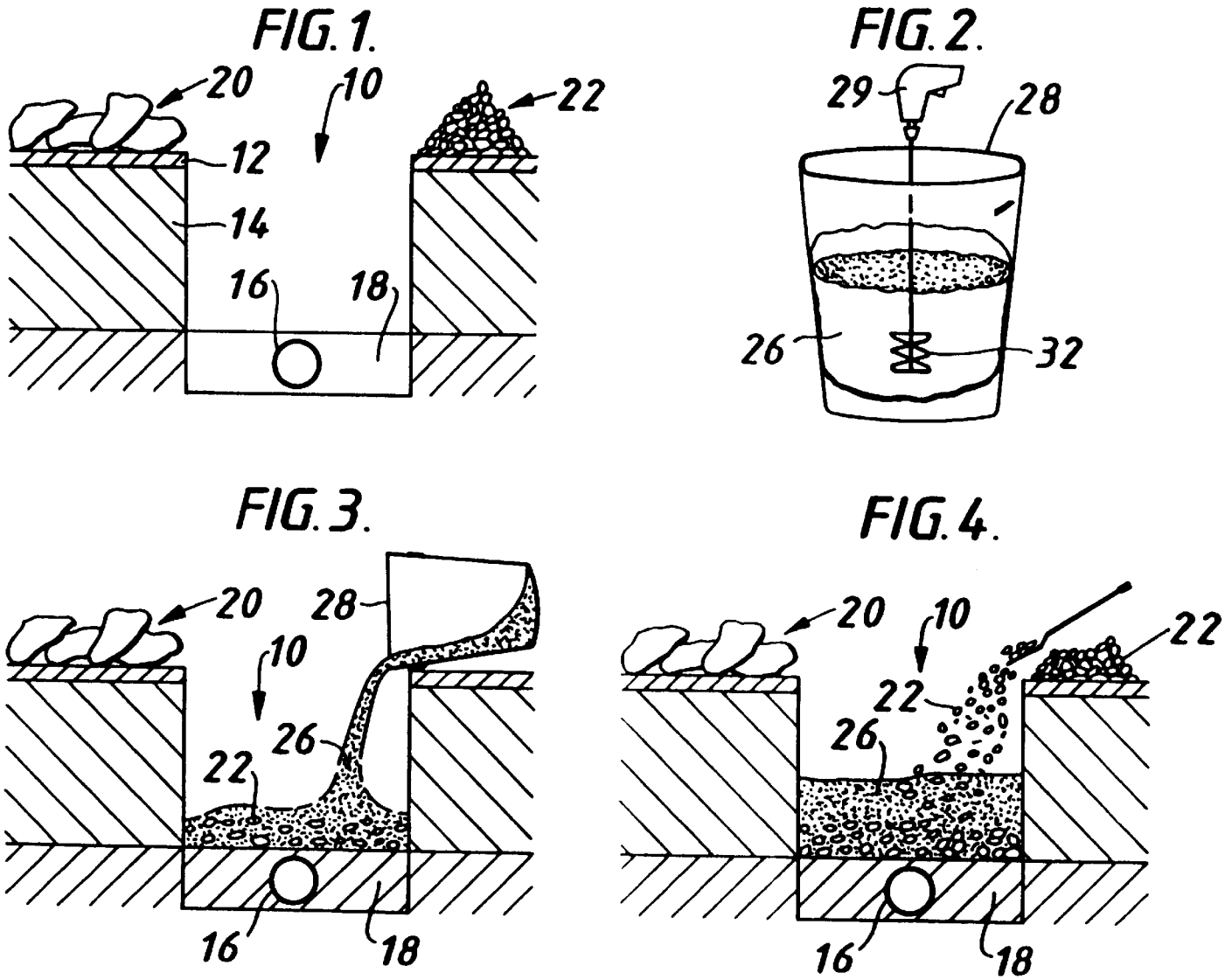
FIG. 1 is a vertical section through an excavated opening.
FIG. 2 is a schematic 3-dimensional view, partly in section, showing a container in which grout is mixed.
FIGS. 3 to 6 are views showing the various stages of the method and FIG. 6 also shows the application of a surfacing layer which is applied subsequently to the completion of the method.

FIG. 1 shows the opening 10 which has been excavated through the pavement 12 of a highway and through the underlying base material 14 to expose a buried service 16 such as a gas main, for example. FIG. 1 shows the position after a repair has been carried out on the main 16 and a layer of infill material 18 has been placed in the opening 10 to protect and separate the main 16 from the material used to backfill the remainder of the opening 10.

The material excavated to produce the opening 10 has been separated into oversize bituminous bound or rigid material 20 and loose excavated spoil 22. The two heaps of materials 20, 22 are stored adjacent the opening 10 on undisturbed pavement 12.

The procedure of filling the opening begins with the provision, on site, of a fluid grout made typically by mixing Portland cement, water and a foaming agent. FIG. 2 shows one example of mixing grout 26 in a container 28. A hand-held power driven drill 29 having a paddle mixer attachment 32 is used to mix the grout 26. Mixing is continued until the required consistency has been reached and it is apparent that the foaming agent has been activated.

In variations of the method, the fluid grout may be provided in forms other than that just described. For example, cement-based products, including products based on Portland Cement, alumina cement, ground blast furnace slag and pulverised fuel ash, or chemicals such as silicates or organic resins, or mixtures of the same may be used.

In variations of the method, instead of the container 28, a conventional fixed or mobile mixer can be used to mix the grout.

The next stage of the method is shown in FIG. 3. An amount of spoil 22 is taken from the heap shown in FIG. 1 and placed in the opening 10 and all of the grout 26 is poured from the container 28 into the opening 10.

Next, as shown in FIG. 4, further spoil 22 is taken from the heap shown in FIG. 1 and placed in the opening 10. This addition is continued until spoil appears at the surface of the grout 26.

Figure 5:
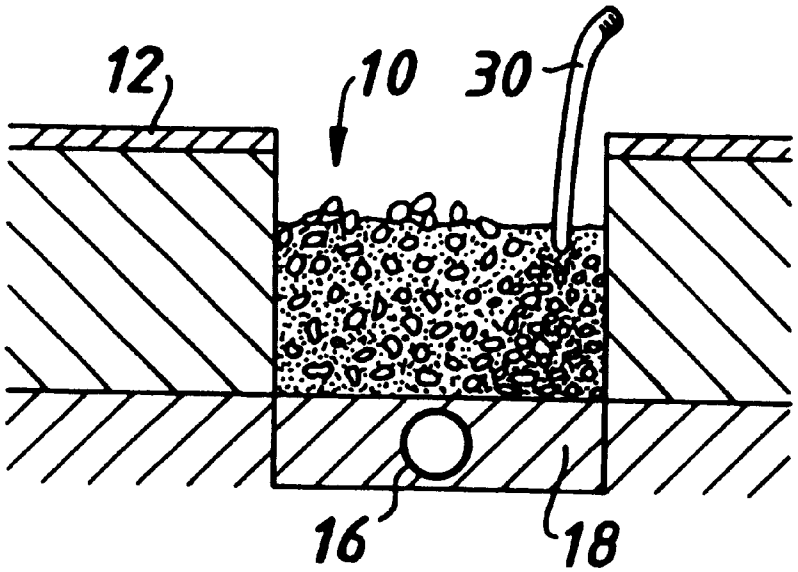

The mixture in the opening 10 is then agitated, as shown in FIG. 5 using mechanical equipment such as a hand-held poker vibrator 30. The heaps of stored excavated materials are omitted for simplicity from FIG. 5. Mixing is continued until it is evident that the voids in the spoil are filled. Further spoil 22 from the heap shown in FIG. 1 is added and the mixture is agitated using the poker vibrator 30 until further agitation proves difficult.

Instead of a poker vibrator 30, a hand-held pole tamper (not shown) can be used to agitate the mixture.

FIG. 5 is an idealised figure. In reality, in the greater majority of cases, it will be necessary to repeat the above described procedure one or more times, beginning with the step shown in FIG. 2, the mixing of the grout 26 in the container 28.

In certain cases, for example where the opening is in a carriageway, it will be preferable to use, at each level of the opening, spoil which has been excavated at that level from the opening (or from some other opening excavated in similar underlying base material) so that the spoil used is at least approximately equivalent to the existing layers in the walls of the opening.

Figure 6:
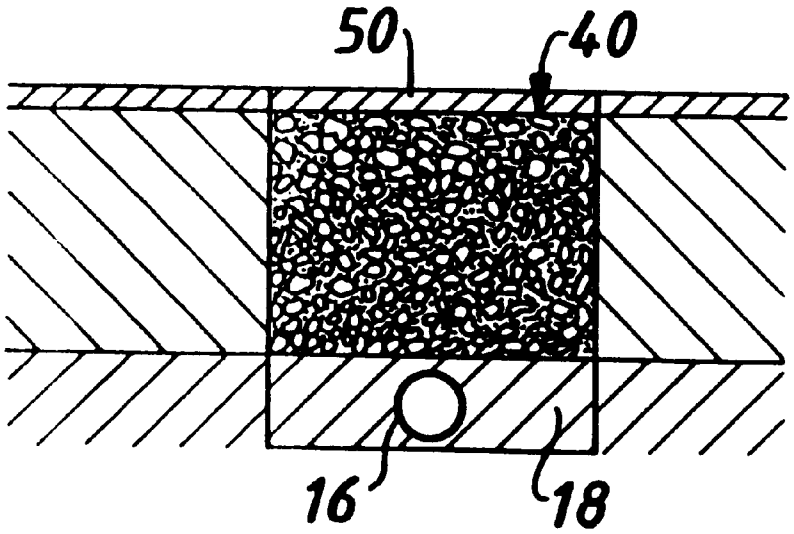

Ultimately, having filled the opening 10 with one or more layers of grout 26 with admixed spoil 22, the surface of the topmost layer will have reached or will have approximately reached the level 40 (FIG. 6). The opening 10 is then protected from the weather and the backfill is allowed to cure in the air and set until it reaches sufficient strength to be able to support a layer 50 of surfacing material, which is applied subsequently, as indicated in FIG. 6, and compacted using a roller or other suitable equipment.

The invention relates to the filling of the excavated hole as far as, or approximately as far as, the level 40. The stage of applying the layer 50 of surfacing material is a subsequently applied stage not forming part of the invention.

I claim:

1. A method of filling an excavated opening through the surface of a highway and through the underlying base material comprising:

(i) placing loose excavated spoil from the excavated opening or from some other similar excavated opening (separated from excavated oversize bituminous bound or rigid surface material) and grout in the opening and adding spoil progressively until the spoil appears at the surface of the grout;

(ii) agitating the mixture of grout and spoil in the opening using mechanical equipment until the grout penetrates the voids in the spoil;

(iii) adding further spoil;

(iv) agitating the mixture until further agitation proves difficult; and (v) repeating steps (i) to (iv) until the surface of the mixture in the opening reaches a level which corresponds or approximately corresponds to the underside of the pavement surfacing layer of the highway.

2. A method according to claim 1 in which at each level of the opening, spoil is used which is equivalent to the existing layers in the walls of the opening.

3. A method according to claim 1 in which said excavated spoil is produced by excavating the opening which is to be filled.

4. A method according to claim 3 in which the majority of the excavated spoil is reused.

5. A method according to claim 1 in which the grout used is mixed on site.

6. A method according to claim 5 in which the grout comprises cement, foaming agent and water.

7. A method according to claim 5 in which all of the grout mixed is placed in the opening.

8. A method according to claim 1 in which the mechanical equipment used at step (ii) comprises a hand-held poker vibrator or a pole tamper.

* * * * *